United States Patent [19]

Verstraeten

[11] Patent Number: 4,943,189

[45] Date of Patent: Jul. 24, 1990

[54] METHOD OF CONTRUCTING A VERTICAL BARRIER WALL IN THE GROUND, AS WELL AS APPARATUS FOR APPLYING THIS METHOD

[75] Inventor: Alexander J. Verstraeten, Knokke-Heist, Belgium

[73] Assignee: Dutch Drilling B.V., Oostburg, Netherlands

[21] Appl. No.: 347,462

[22] Filed: May 4, 1989

[30] Foreign Application Priority Data

Mar. 6, 1989 [NL] Netherlands ..... 8900541

[51] Int. Cl.[5] ..... E02D 5/20

[52] U.S. Cl. ..... 405/267; 405/184; 405/266; 37/191 R; 37/80 R

[58] Field of Search ..... 37/83, 84, 191 R, 191 A, 37/192 R, 192 A; 405/184, 266, 267

[56] References Cited

U.S. PATENT DOCUMENTS 3,452,545 7/1969 Malloy ..... 405/267

3,452,546 7/1969 Novet ..... 405/267

4,249,836 2/1981 Schmednecht ..... 405/267

4,379,658 4/1983 Schmednecht ..... 405/267

*Primary Examiner*—Dennis L. Taylor

*Assistant Examiner*—Arlen L. Olsen

*Attorney, Agent, or Firm*—Kenyon & Kenyon

[57] ABSTRACT

A method of constructing a vertical barrier wall in the ground (1,3) wherein two spaced apart, deep wells (2) are excavated in the ground. The walls (2) are interconnected near the bottom thereof by a substantially horizontally extending canal (7). Subsequently, there are provided in the wells (2) and the canal (7) a looped, closed chain (11) carrying excavators (12). The two ends of the chain are interconnected above the ground level. The closed chain loop is then driven in a direction of circulation and moved simultaneously upwards. The soil material 1 present between the wells (2) is thus "sawn through", thereby forming a narrow trench (26), which is filled with a supporting fluid (4).

11 Claims, 4 Drawing Sheets

METHOD OF CONTRUCTING A VERTICAL BARRIER WALL IN THE GROUND, AS WELL AS APPARATUS FOR APPLYING THIS METHOD

FIELD OF THE INVENTION

This invention relates to a method of constructing a vertical barrier wall in the ground. The object of such walls is always to isolate a given, usually strongly polluted area from the environment, e.g. to prevent groundwater pollution outside the isolated area.

BACKGROUND OF THE INVENTION

A great many methods are known for constructing such a barrier wall, of which those most in use will be briefly described hereinafter.

A first known method consists in excavating a trench by means of an excavator provided with a chain having excavator buckets running about two guide rollers disposed vertically one above the other. During excavation, the chain is driven in a direction of travel and is simultaneously displaced in a horizontal direction. The trench excavated by the excavator is filled with a supporting fluid, e.g. bentonite, directly behind the excavator. Such a method is described in U.S. Pat. No. 4,379,658.

This method has the drawback that the depth of the trench is limited by the vertical height of the excavator and this is limited for practical reasons to about 10 meters. The width of the excavated trench is about 50 cm. The bentonite consumption, in view of this width, is substantial.

Another method of making a deep trench consists in providing juxtaposed wells by means of a hydrocutter, allowing to dig wells down to a large depth of as much as 200 meters. The cutter has a width of about 50 to 60 cm and a length of about 3 meters. The excavating method comprises making a first well, subsequently a second well at a distance slightly smaller the length of the cutter, after which the soil material remaining between the two wells is removed. The hydrocutter is adapted to operate in a bentonite fluid column, so that there is no danger that the wells cave in during the excavation. Such a method of constructing a deep trench is described in the non-prepublished Dutch patent application No. 87.02430.

Although the hydrocutter is adapted to operate down to a depth of about 200 meters, the trenches dug therewith cannot be deeper in practice than about 50 meters, because at a larger depth, the lateral deviation of the cutter may become too large. When two excavated juxtaposed wells exhibit opposite, lateral deviations, it can no longer be ensured that the panels excavated with the hydrocutter are continuous, which is necessary to form a continuous wall. Due to the width of the trench of 50 to 60 cm, the bentonite consumption in this excavating method, too, is substantial.

A third known method of excavating a deep trench consists in vibro-driving H-beams into the ground in juxtaposed relationship, while simultaneously injecting a bentonitecement slurry into the hole thus formed. The depth of the trench is limited to about 20–35 meters, since at larger depths it is no longer certain that the panels successively formed are continuous. The width of the trench may be considerably narrower than the above indicated width of 50–60 cm, so that in the last method, the consumption of supporting fluid is substantially less (U.S. Pat. No. 4,249,836).

SUMMARY OF THE INVENTION

It is an object of the present invention to provide a method which enables to install barrier walls down to a substantially larger depth in the ground, with the certainty that the panels successively dug link up with each other and the wall may be of limited thickness to reduce the supporting fluid consumption.

Starting from the method described in Dutch patent application No. 87.02430, wherein two deep interspaced wells are dug in the ground, after which the soil material present between the two wells is removed, the method according to the present invention is characterized by excavating a substantially horizontal canal interconnecting the two wells near the bottom thereof, installing in the two wells and the canal connecting said wells a looped, closed chain provided with excavators, the two ends of said chain being interconnected above ground level, and driving the chain in circulation direction, while simultaneously moving the closed chain loop upwards and filling the trench formed thereby with a supporting fluid.

By applying the above described method, the two spaced wells to be excavated can be dug at a considerably larger distance from one another than is possible in the method according to the above Dutch application No. 87.02430. After excavating the horizontal canal, connecting the two wells, and introducing a digging chain through the two wells and the horizontal connecting canal, the soil present between the wells can be "sawn through" by driving the digging chain in the direction of circulation and simultaneously displacing it upwards, thereby producing a very narrow trench, the filling up of which is prevented by appropriate means. In rocky soils, the width of the trench is not larger than some centimeters, while in soft soils the width of the trench will be about 15 cm. Due to the small width of the trench, the consumption of supporting fluid and the like is minimal. Any lateral deviations produced during the excavation of the wells no longer give problems, because during the "sawing through" of the soil layer present between these two wells, there is automatically produced a continuous connection from one well to another and, consequently, a continuous wall can be formed.

Further elaborations of the method according to the present invention are defined in the subclaims.

BRIEF DESCRIPTION OF THE DRAWINGS

The method according to the present invention and embodiments of the apparatus for its application will be further explained, with reference to the accompanying drawings, in which.

DETAILED DESCRIPTION OF THE INVENTION

Figures 1, 2:
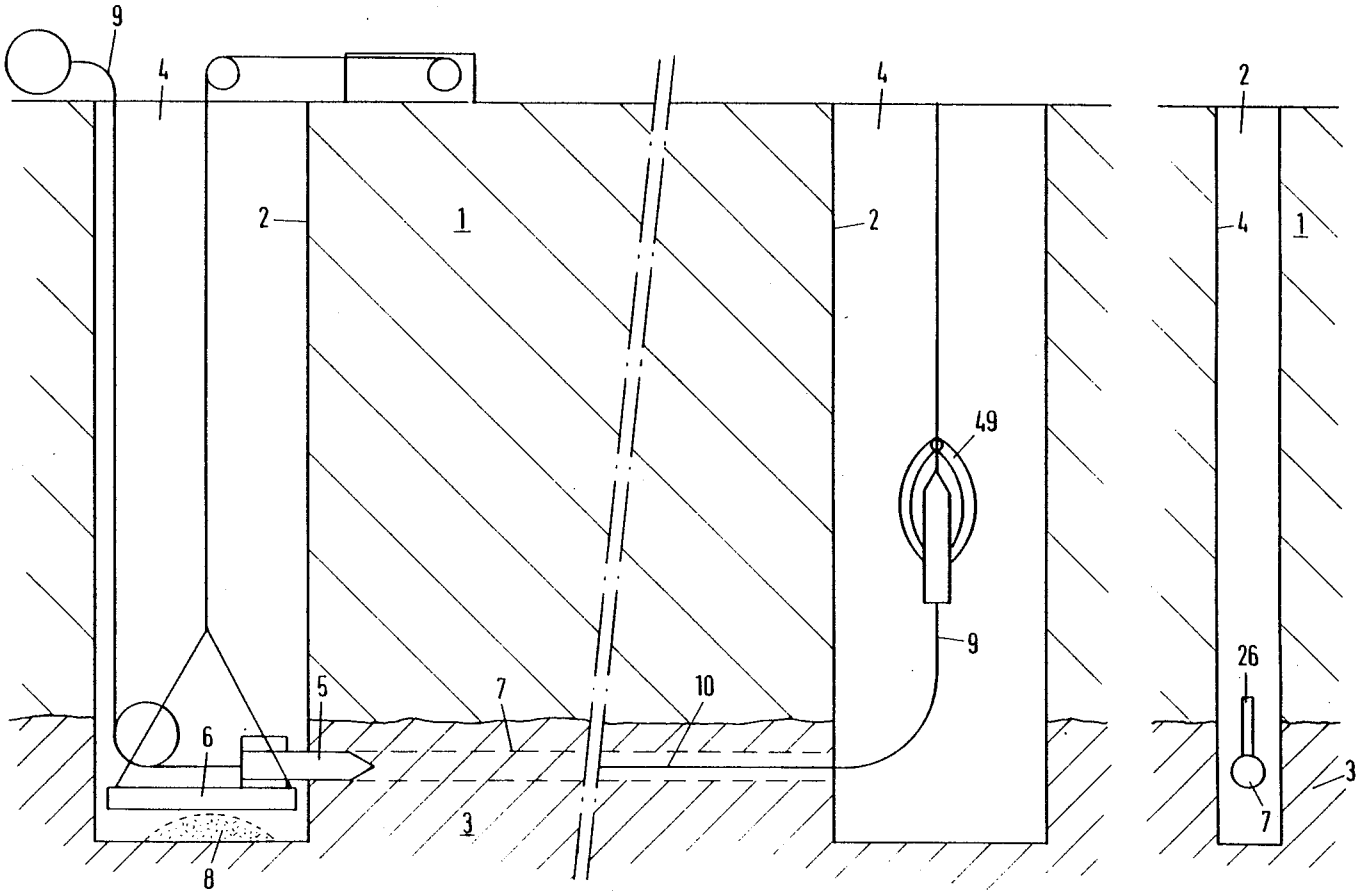
FIG. 1 shows a first phase of the method of excavating a trench in the ground.
FIG. 2 is a vertical cross sectional view of a well shown in FIG. 1.
Figure 3:
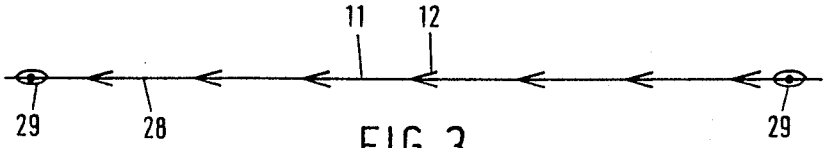
FIG. 3 shows a segment of a digging chain.

FIG. 1 shows the first phase of the method of excavating a trench. In the ground, two wells are excavated at a large distance apart, which may be as long as 100 meters, by means of a hydrocutter, as described in Dutch patent application No. 87.02430. The two wells 2 extend down to an impermeable soil layer 3. During the excavation of wells 2, supporting fluid 4 is injected therein, e.g. bentonite. After excavating the two wells 2, a carriage 6 is lowered in one of these wells, on which carriage is placed a controllable excavating mole 5. Such a mole is known per se and need not be further described within the framework of the present invention. The mole can be steered in the direction of the other well 2 by means of advanced control techniques. The mole can be driven electrically or hydraulically. Preferably, however, the mole is driven by bentonite at high pressure, supplied to mole 5 through a hose 9 extending up to ground level. The mole excavates a horizontal canal 7 interconnecting the two wells 2 approximately near their bottoms. The soil material 8 removed by mole 5 during the excavation of canal 7 ends up in the well 2 of departure and can subsequently be removed from this well.

When excavating mole 5 has reached the other well 2, this is fished out of this well 2 by means of a grab 49. An auxiliary chain 10 is provided on mole 5 or on the medium feeder hose 9 therefor. In this manner, during the lifting of mole 5, an auxiliary chain 10 is passed through the left well 2, the horizontal canal 7 and the right well 2. Subsequently, the digging chain proper is connected to the auxiliary chain 10, so that this excavating chain, passes from ground level through the left well 2, horizontal canal 7 and up against through the right well 2 to above ground level after which the two ends of chain 11 are interconnected, thereby obtaining a closed chain loop.

Figure 4:
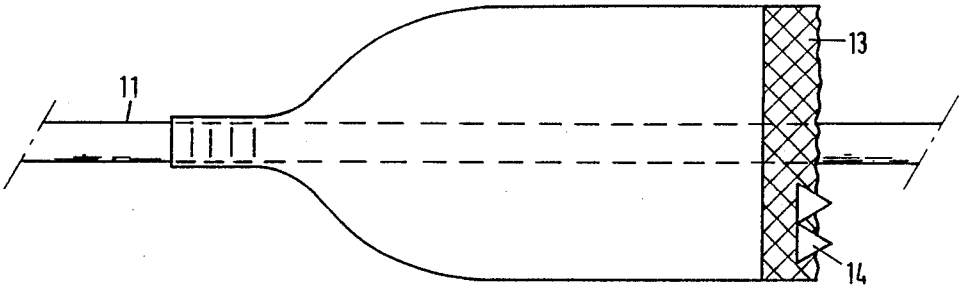
FIG. 4 shows an excavator of the digging chain.
Figure 5:
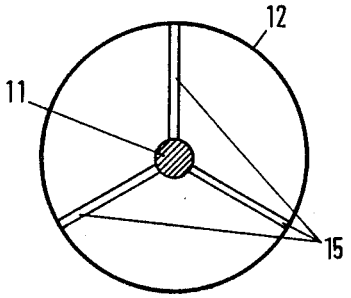
FIG. 5 is a side view of the excavator shown in FIG. 4.

Digging chain 11 (see FIGS. 3–6) comprises a plurality of separate segments 28, which are interconnected by coupling pieces 29. Uniformly spaced, bucket-shaped excavators 12 are provided on the excavating chain, said buckets having basically a cylindrical or conical cross section. One end (see FIG. 4) of excavating bucket 12 is connected to digging chain 11, while the opposite end consists of a hard-alloy cutting edge 13, possibly studded with cutting bits 14. Radially arranged within excavating bucket 12 are three supporting partitions 15, which at one side bear on the digging chain and at the other are connected to the inner wall of bucket 2. When the method is used in rocky soils, excavating buckets 12 can be replaced by cutting bits of hard alloy or possibly even diamond fitted directly on chain 11.

Figure 6:
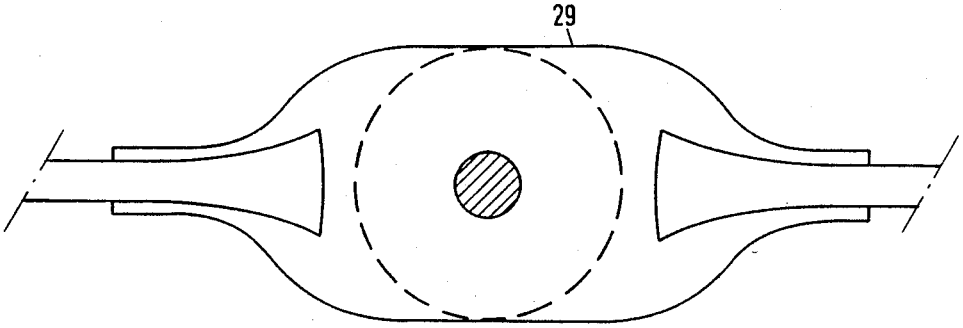
FIG. 6 is a diagrammatic view of a coupling piece for interconnecting chain segments according to FIG. 3.

The coupling 29 shown diagrammatically in FIG. 6 is a known per se chain coupling. The only important point is that this coupling 29 has the same diameter as that of excavating buckets 12.

Figure 7:
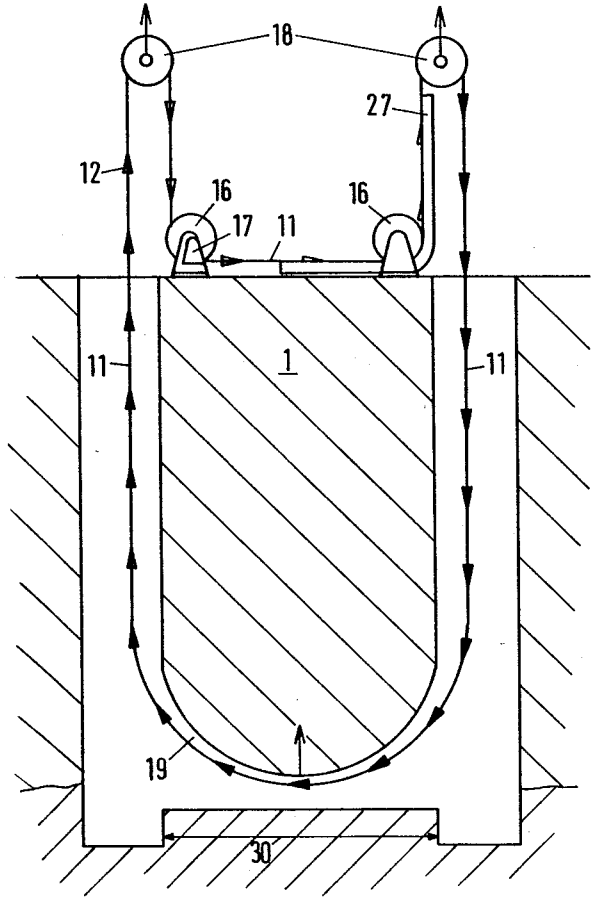
Figure 11:
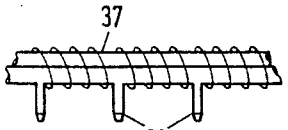
FIG. 11 is a partial side view of FIG. 10.

In FIG. 7, the digging chain 11 is installed in the two wells 2 and in the horizontal canal 7 connecting said wells, said chain 11 being passed above ground level over four guide rollers 16, 18, one of which rollers 16 is driven by a motor 17. The closed chain loop travels conterclockwise. In principle, digging chain 11 will hang in a so-called catenary, which also defines the shape 19 of the cut. At least one of the guide rollers 18 functions as a tensioning roller for the digging chain 11. Said tensioning roller 18 will be displaced in upward direction when the chain is driven by motor 17 in the direction of circulation, so that the soil layer 1 located between the two wells 2 is cut from the bottom to the top. The excavating buckets 12 mounted on digging chain 11 take the excavated soil upwards and, after passing the first tensioning roller 18, are emptied into a soil collector 27.

The vertical length of travel of tensioning rollers 18 has been chosen in such a manner that when the highest position is reached by the tensioning rollers 18, a chain segment 28 can be taken out of digging chain 11 to shorten the chain, whereafter tensioning rollers 18 are moved back to their lowest position for them to be subsequently moved up again until a next chain segment 28 can be taken out of the digging chain.

Figure 8:
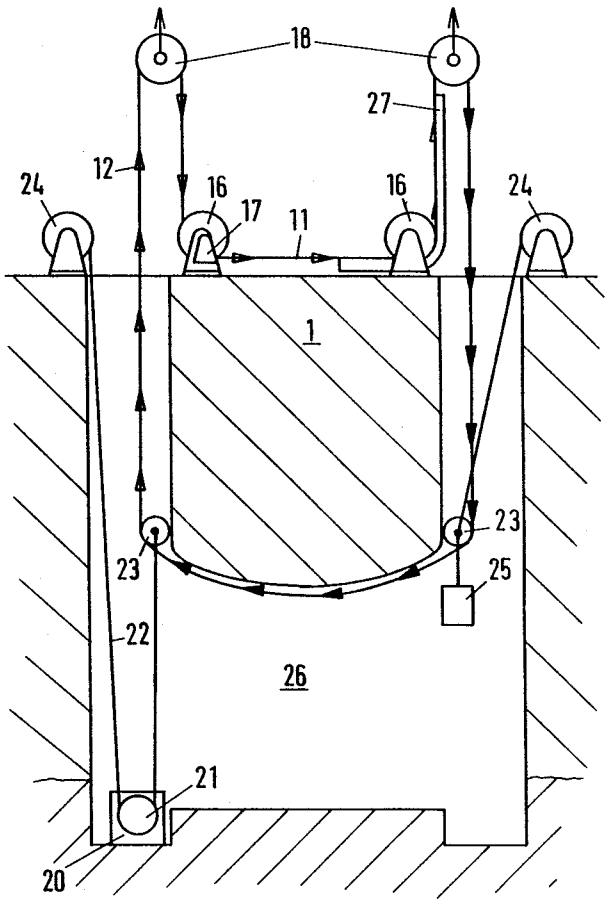
FIG. 7–9 are different cross-sectional views of a trench to be excavated in different phases of operation.

The lowest portion of digging chain 11 preferably traverses a substantially horizontal or at least less strongly curved path than that shown in FIG. 7. This can be achieved by providing tensioning means, as shown in FIG. 8. Such tensioning means may for instance include a rope sheave 23 weightened with a weight 25, said sheave being connected to a winch placed on the surface of the ground.

The weight 25 suspended from rope sheave 23 exerts on digging chain 11 a force that causes the cut shape 19 as shown in FIG. 7 to extend more horizontally.

Instead of a weighted rope sheave, 23, a rope sheave 23 can be employed that is connected through a rope 22 to an anchor block 20 lowered into a well 2. Rope 22 runs from anchor block 20 to a winch 24 placed above the surface of the ground, by means of which rope sheave 23 can be brought into, or maintained in, a desired position.

Figure 9:
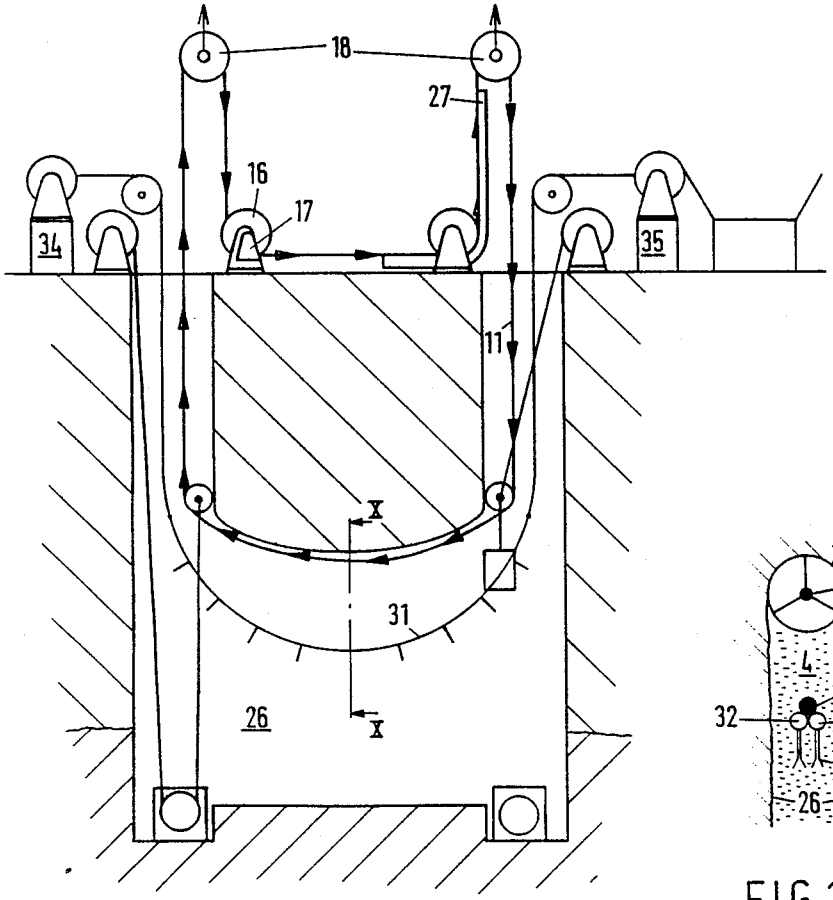

During the excavation of the trench 26 by means of digging chain 11, trench 26 is filled with supporting fluid from the two wells 2, which are filled with supporting fluid 4. This supporting fluid may consist of bentonite or bentonite-cement with or without a filler. With certain types of soil, instability may be produced around the excavated trench 26, so that the trench 26 may be filled up. To prevent this, it is necessary to use a very heavy supporting fluid 4, or a hardening accelerator should be used in the trench 26. This can be done in the manner shown in FIGS. 9–12. As shown in FIG. 9, a carrier cable 31 is provided underneath digging chain 11 and two hoses 32, 33 are attached to said cable 31, the under-sides of said hoses being fitted with jet nozzles 36. Carrier cable 31 is suspended from two winches, while hoses 32, 33 are connected to the pumps 34, 35, respectively.

When bentonite is used as the supporting fluid, cement slurry can be injected into trench 26, e.g. through hose 32, while water-glass is injected into trench 26 through hose 33. In trench 26 a bentonite-cement mixture is formed which hardens and solidifies quickly under the influence of water-glass. When a bentonite-cement mixture is used as the supporting fluid, only water-glass as hardening accelerator need be supplied thereto through one of hoses 32, 33.

To obtain a proper mixing of the slurry present in trench 26, carrier cable 31 is transported backward and forward with hoses 32, 33 suspended therefrom by means of the two winches, so that the injected waterglass and possibly the likewise injected cement slurry are effectively mixed. This mixing effect can be improved still further by wrapping the bundle formed by carrier cable 31 and the two hoses 32, 33 with resilient elements 37, which will reinforce the stirring effect during the reciprocation of carrier cable 31.

This mixing method has the additional advantage that soil portions which find their way into the bentonite slurry 4 during excavation are mixed with slurry 4 by cable 31 and hoses 32, 33 connected thereto, so that a homogeneous wall is obtained.

Figure 12:
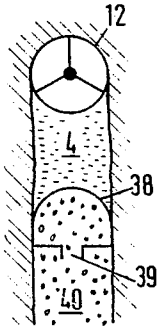
FIG. 12 is a variant cross-sectional view according to FIG. 10.
Figure 10:
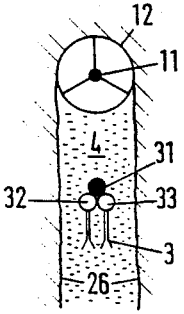
FIG. 10 a cross-sectional view taken on the line X—X of FIG. 9.

Instead of carrier cable 31 and injection hoses 32, 33 suspended therefrom, use can be made of a flexible tube 38, shown in FIG. 12, having substantially the width of trench 26. Provided at the under-side of said flexible tube 38 are outlet openings 39. Tube 38 is connected through hoses to one of the pumps 34, 35, which pump a setting or non-setting mixture into tube 38. This mixture will exit from tube 28 through openings 39, as a result of which hose 38 and the supernatant lighter supporting fluid 4 will be pressed upwards.

What I claim is:

1. A method of constructing a vertical barrier wall in the ground, in which two spaced apart, deep wells are excavated in the ground, after which the soil material present between the two wells is removed, characterized by excavating a substantially horizontal canal interconnecting the two wells near the bottom thereof, installing in the two wells and the canal connecting said wells a looped, closed chain carrying excavators, the two ends of said chain being interconnected above ground level, and driving the chain in a direction of circulation, while simultaneously moving the closed chain loop upwards and filling the trench formed thereby with a supporting fluid.

2. A method as claimed in claim 1, characterized by installing underneath the digging chain a carrier cable from which is suspended at least one hollow tube having uniformly spaced, downwardly oriented jet nozzles for injecting a hardening accelerator for the supporting fluid into the trench, displacing said carrier cable simultaneously with the digging chain in upward direction.

3. A method as claimed in claim 2, characterized in that the carrier cable and the hollow tube or tubes connected thereto are wrapped with resilient elements and the assembly thus formed is reciprocated in the plane of the carrier cable to improve the mixing of the supporting fluid with the hardening accelerator injected into it.

4. A method as claimed in claim 1, characterized by installing underneath the digging chain a flexible tube having a width corresponding with the excavated trench, said tube being provided at its under-side with outlet openings, and pumping through said tube a fluid having a specific density higher than that of the supporting fluid.

5. Apparatus for constructing a vertical barrier wall in the ground, comprising means for digging two horizontally spaced vertical wells;

means for excavating a substantially horizontal canal interconnecting said wells near the bottom thereof;

means for filling the wells with a supporting fluid during excavation;

said means for excavating includes a closed-loop digging chain (11) provided with excavating tools (12);

a supporting construction provided with at least three guide rollers (16, 18) for said digging chain (11) at least one of said guide rollers (16, 18) being drivable (16) and at least one (18) being movable in the vertical direction thereby providing means to move said closed loop chain upwardly so as to excavate said canal.

6. Apparatus as claimed in claim 5, characterized in that the digging chain (11) comprises a series of chain segments (28) connected through couplings (29).

7. Apparatus as claimed in claim 6, characterized in that each chain segment (28) is provided with uniformly spaced excavating buckets (12) of substantially cylindrical cross section, said buckets (12) being provided at the open front with a hard alloy cutting edge (13) and being connected to the chain by means of radially arranged partitions (15).

8. Apparatus as claimed in claim 6, characterized in that each chain segment (28) is provided with uniformly spaced cutting elements of hard alloy or diamond.

9. Apparatus as claimed in claim 5, characterized in that means (23, 25) are provided for varying the loop shape of the freely suspended digging chain (11).

10. Apparatus as claimed in claim 9, characterized in that said means comprise a weighted rope sheave (23, 25), which is adjustable vertically by means of a winch (24).

11. Apparatus as claimed in claim 5, characterized in that the apparatus further comprises a carrier cable (31) suspended from two cable winches, from which cable (32) is suspended at least one hollow tube (32, 33) provided at its underside with jet nozzles (36) and connected to pumps (34, 35) for injecting into the trench (26) a hardening accelerator for the supporting fluid (4).

* * * * *